US007874477B2

(12) United States Patent
Sutherland et al.

(10) Patent No.: US 7,874,477 B2
(45) Date of Patent: Jan. 25, 2011

(54) CARTON WITH TOP DISPENSING FEATURE

(75) Inventors: Robert L. Sutherland, Kennesaw, GA (US); Raymond R. Spivey, Sr., Mableton, GA (US); Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 403 days.

(21) Appl. No.: 11/970,801

(22) Filed: Jan. 8, 2008

(65) Prior Publication Data

US 2008/0110968 A1 May 15, 2008

Related U.S. Application Data

(63) Continuation-in-part of application No. 11/069,238, filed on Mar. 1, 2005, now Pat. No. 7,331,507, which is a continuation of application No. 10/626,234, filed on Jul. 24, 2003, now Pat. No. 6,869,009, which is a continuation-in-part of application No. 10/360,232, filed on Feb. 6, 2003, now Pat. No. 6,604,677.

(51) Int. Cl.
*B65D 17/28* (2006.01)
*B65D 5/54* (2006.01)

(52) U.S. Cl. ..... 229/242; 206/427; 206/831; 221/1; 229/122.1; 229/925

(58) Field of Classification Search ..... 221/1
See application file for complete search history.

(56) References Cited

U.S. PATENT DOCUMENTS 2,115,673 A 4/1938 Stompe
2,837,254 A 6/1958 Goldstein
3,155,273 A 11/1964 Cote
3,300,115 A 1/1967 Schauer
3,346,167 A 10/1967 Schmidt
3,517,858 A 6/1970 Farquhar
3,829,006 A 8/1974 Spiegel
4,155,449 A 5/1979 Bryne
4,252,236 A 2/1981 Roccaforte
4,318,474 A 3/1982 Hasegawa
4,331,289 A 5/1982 Killy
4,396,143 A 8/1983 Killy
4,398,636 A 8/1983 Baxter
4,417,661 A 11/1983 Roccaforte
4,426,035 A 1/1984 Dieckow
4,498,581 A 2/1985 Dutcher
4,620,664 A 11/1986 Kaufman et al.
4,735,315 A 4/1988 Oliff et al.
5,249,681 A 10/1993 Miller
5,385,234 A 1/1995 Stout et al.
5,505,372 A 4/1996 Edson et al.

(Continued)

*Primary Examiner*—Gary E Elkins
(74) *Attorney, Agent, or Firm*—Womble Carlyle Sandridge & Rice, PLLC

(57) ABSTRACT

A carton with a new dispenser that can be opened by a pull tab with this dispenser flap being placed in a corner of the top panel of the carton so that it is adjacent to the tops of the small necks of the bottles for easy opening and removal or for opening and reclosing. The dispenser flap is held in position by resistant tear lines but can be easily removed by an attached pull tab that is loosely connected to the top panel.

21 Claims, 2 Drawing Sheets

U.S. PATENT DOCUMENTS

| | | | | |
|---|---|---|---|---|
| 5,622,309 | A | 4/1997 | Matsuda et al. | |
| 6,478,219 | B1 | 11/2002 | Holley, Jr. | |
| 6,604,677 | B1 | 8/2003 | Sutherland et al. | |
| 6,669,083 | B2 * | 12/2003 | Bates | 229/240 |
| 6,866,186 | B2 | 3/2005 | Fogle et al. | |
| 6,869,009 | B2 * | 3/2005 | Sutherland et al. | 229/242 |
| 7,000,803 | B2 * | 2/2006 | Miller | 221/305 |
| 7,331,507 | B2 * | 2/2008 | Sutherland et al. | 229/242 |
| 2006/0091192 | A1 * | 5/2006 | Coltri-Johnson | 229/242 |

* cited by examiner

CARTON WITH TOP DISPENSING FEATURE

CROSS-REFERENCE TO RELATED APPLICATIONS

This application is a continuation-in-part of U.S. patent application Ser. No. 11/069,238 filed Mar. 1, 2005, now U.S. Pat. No. 7,331,507 which is a continuation of U.S. patent application Ser. No. 10/626,234 and filed Jul. 24, 2003, incorporates the disclosure thereof, now U.S. Pat. No. 6,869,009, issued Mar. 22, 2005, which is a continuation-in-part of U.S. patent application Ser. No. 10/360,232 filed Feb. 6, 2003, and incorporates the disclosure thereof, now U.S. Pat. No. 6,604,677, issued Aug. 12, 2003, all of which are incorporated herein by reference in their entireties.

BACKGROUND OF THE INVENTION

1. Field of the Invention

The present invention relates generally to an enclosed paperboard carton capable of enclosing containers with a top of a smaller diameter than the bottom, which carton has a unique opening and dispensing feature in the top panel which allows the containers to be removed or dispensed one at a time by grasping the top of the container and pulling it through opening. The opening is closed by a dispensing flap that is tightly attached to a corner of the top panel by a resistant tear line. The dispenser flap is attached to a pull tab that is loosely attached to the top panel so that it can be easily completely or partially detached from the top panel for opening the dispenser flap. When containers are to dispensed from this carton, the dispenser flap is opened and the carton is placed on its end with the dispenser being located in a corner of the top panel adjacent the end on which the carton is placed. The dispenser flap can be constructed so it can be reclosed.

2. Background

Fully enclosed cartons capable of enclosing cans have been used in the past that have a feature for dispensing the cans one at a time. Dispensers have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

In effect, many of these dispensers destroy the overall carton integrity once they have been opened.

Many of these dispensers do not have any means for the easy opening of the dispenser for dispensing the containers inside the carton one at a time. Furthermore, many dispensers are not set up so that the containers inside the carton roll into the position for dispensing once a container has been removed from the dispenser.

PRIOR ART

U.S. Pat. No. 5,249,681 to Miller discloses a carton with an outlet port in each side wall with both being located on a single longitudinal axis that is normal to the side walls. This carton is loaded with cans which can be removed by standing the carton on its end near where the dispensers are located and opening the flaps closing the ports. As the ports are only slightly larger than the cans it is necessary to push a can from one port through the port on the other side as a person's fingers are too large to grasp a can in the small opening between the can and the edge of the port. This explains the necessity of having two identical ports on each side wall in longitudinal alignment. The necessity of having two ports tends to weaken the structural integrity of the Miller carton. This carton cannot be easily moved from one location to another after both ports have been opened without a risk that the cans will fall out.

U.S. Pat. No. 4,364,509 to Holley, Jr. et al. discloses a fully enclosed carton with a dispenser in one of the end walls. This dispenser is formed in the end wall by tearing out an end flap and lowering it into proper position. Expansions slits are provided in the side wall for the user's fingers to grasp the ends of the exiting can. This carton is not adapted for use with bottles, because of the necessity of grasping the ends of the container for removal. In addition, it is not adapted for carrying cans once the carton has been opened as they are likely to roll out of the dispenser.

SUMMARY OF THE INVENTION

It is an object of this invention to provide a dispenser or opening in a carton for the removal of bottles that have a smaller diameter at the top than at the bottom. It is a further object of this invention to provide a dispenser that is resistant to being accidentally opened during handling or stacking of the cartons by the weight of a container adjacent the dispenser flap. It is the further object to provide a dispenser that can be easily opened but is resistant to being accidentally opened. It is another object of this invention to provide a dispenser so that bottles with a smaller neck than body can be grasped through the dispenser and removed without the necessity of having a second dispenser in longitudinal alignment with this dispenser. In other words, it is an object of this invention to provide a single dispenser without the necessity of a second dispenser that weakens the structural integrity of the carton. It is still another object of this invention to provide a carton with a dispenser that will permit the carton to be moved from one location to another after it has been opened without discharging containers. An additional object is to provide a carton with a dispenser whereafter the removal of the container, another container will move into position with respect to the dispenser for easy removal.

It is a further object to provide a carton where the dispenser can be opened and a container removed and the dispenser reclosed. An additional object is to provide a dispenser that the consumer may elect to open and remove or reclose. It is a final object to provide a means to include a coupon with the dispenser that can be removed by the consumer when opening the carton and removing a container.

Briefly described, in a preferred form, the objects of this invention are achieved by providing an enclosed carton that has an unique dispenser or opening in a corner of the top panel of the carton. This carton is generally rectangular and has a bottom, top, two sides, and two ends. The carton is foldably constructed from a blank having panels and flaps. The dispenser or opening is formed in one of the corners on the top panel of the carton by providing a tear line between the dispenser flap and the top panel that is resistant to tearing. A pull tab is attached to the dispenser flap with the pull tab being loosely attached to the carton for easy detachment so that it can be used for pulling the dispenser flap open. Since the bottles designed to be carried by this carton are cylindrical, the dispenser flap needs to be circular. It may be truncated at the adjacent corner of the top panel by placing the tear line for the dispenser flap along the fold lines for connecting the top end flaps and side panel to the top panel.

The dispenser flap on this carton is opened to provide the dispenser opening by placing the carton on end with the dispenser being located near such end. Once a dispenser flap has been removed by pulling on the pull tab, a person may remove a bottle by reaching into the dispenser opening and pulling a bottle by the neck which has a smaller diameter than the body. Other bottles roll towards the dispenser opening after the removal of the bottle. It is necessary to place the dispenser opening in the top panel as the bottles with smaller necks and bodies should be stacked in the carton in an upright position to prevent spillage and damage. The removal of these bottles is facilitated by virtue of the small diameter of the neck of the bottle being located near the top panel where the dispenser opening is located. It has been discovered that it is not necessary to have two openings in each side panel on the same longitudinal axis in respect to bottles with smaller necks than bodies.

The dispenser opening can be constructed by providing a tear line defining the dispenser flap which forms an opening for removing bottles when opened. When the dispenser flap is truncated at the adjacent corner of the top panel, the dispenser flap can be easily removed if the fold lines between the points where the tear lines in the top panel intersect the fold lines between the top panel and side and end panels and from those points on to the intersection of these fold lines at the adjacent corner intersect are also constructed as tear lines. Some of these fold lines between the top and end and side panel, especially between the top and side panel, can be constructed as fold lines with no tear line to permit the dispenser flap to be opened and a container removed and the flap reclosed to secure the carton. A coupon can be attached or printed on the dispenser flap as a marketing tactic to the consumer.

This carton can be constructed by gluing, taping, stapling and the like, or by locking. It may have handles in the end panels for carrying so that the bottles are carried in an upright position to help minimize damage to the carton or the containers contained therein.

These and other objects, features, and advantages of the present invention will become more apparent upon reading the following specification in conjunction with the accompanying drawing figures.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

Figure 1:
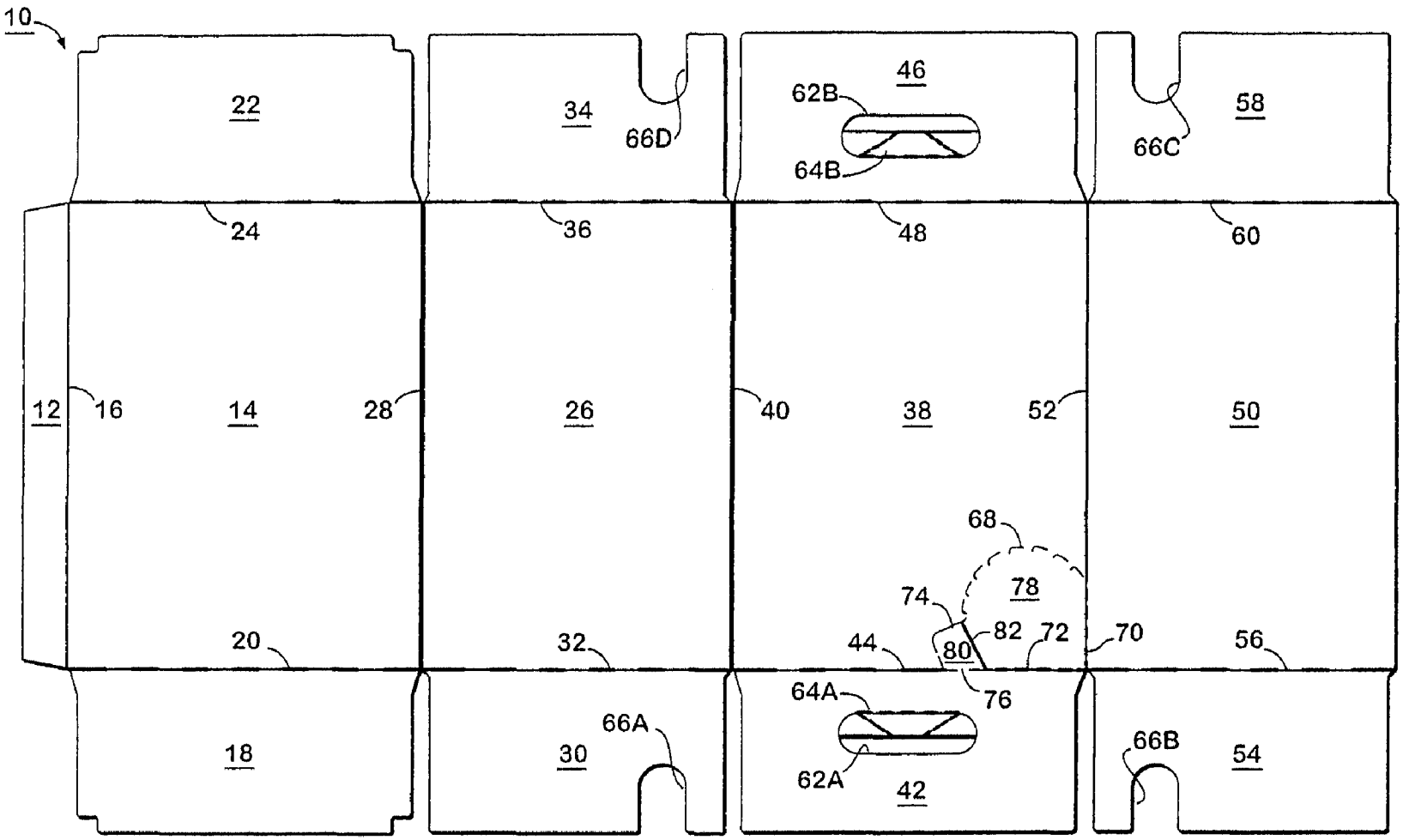
FIG. 1 is a plan view of a blank from which a carton according to this invention is formed.

The present invention is intended primarily for use with bottles or cans that have a top with a smaller diameter than the bottom. The blank 10 is formed from a foldable sheet material, such as paperboard. The blank 10 has a glue flap 12 which is attached to the bottom panel 14 by fold line 16. Bottom end flaps 18 and 22 are attached to bottom panel 14 by fold lines 20 and 24 respectively. Bottom panel 14 is attached to side panel 26 by fold line 28. Bottom panel 26 is attached to side end flaps 30 and 34 by fold lines 32 and 36 respectively. Side panel 26 is attached to top panel 38 by fold line 40. Top panel 38 is attached to top end flaps 42 and 46 by fold lines 44 and 48 respectively. Side panel 50 is attached to top panel 38 by fold line 52. Side panel 50 is attached to side end flaps 54 and 58 by fold lines 56 and 60 respectively.

This carton may be provided with handles 62A and 62B formed in top end flaps 42 and 46 respectively. The handles 62A and 62B may have handle flaps 64A and 64B. As this handle has a two ply structure the two handle cutouts 66A-B are provided so that a person's hand can be extended through handle 62A and handle cut outs 66A-B to lift one end of the carton. On the other end the hand is extended through handle 62B and handle cut outs 66C-D. On both ends two plys of paperboard are supporting the handle.

A resistant tear line 68 is provided in the top panel 38, with the resistant tear line 70 extending along fold line 52 until it intersects resistant tear line 72 extending along fold line 44. These resistant tear lines 68, 70, and 72 tightly connect the dispenser flap 78 to the top panel 38, top end flap 42 and side panel 50. A pull tab 80 is connected to dispenser flap 78 by fold line 82. The pull tab is loosely attached to the top panel 38 and top end flap 42 by loosely connected slits 74 and 76. If it is desired to be able to reclose the dispensing flap 78, tear line 70 can be made more resistant to tearing so that the dispensing flap can remain attached to the carton along tear line 70 and reclosed after removing a bottle B. In fact, tear line 70 can be left as only a fold line. In addition, the portion of tear lines 70 and 72 near the intersection of these lines can be left resistant to tearing or simply left as fold lines for reclosing. Preferably, tear line 70 is left balanced between being resistant to tearing and loosely attached to the carton so a person at the time of opening can choose to remove the dispensing flap or leave it attached for reclosing.

It will be understood by those skilled in the art that the carton of the present invention is generally symmetrical about a horizontal line of bisection, as viewed when FIG. 1 is rotated lengthwise. This symmetry aids in the efficient production of the present carton.

In forming this blank 10 into a carton, the carton is formed into a sleeve with glue flap 12 being glued to side panel 50. Bottles B having a top portion of a smaller diameter than the bottom portion can be loaded into the carton with the bottle cap C and bottle neck N being adjacent to the top panel 38. The various end flaps 18, 22, 30, 34, 42, 46, 54, and 58 can be glued together to finish the erection of the loaded carton.

It should be realized that this carton sleeve could be held together by locks rather than glue.

Figure 2:
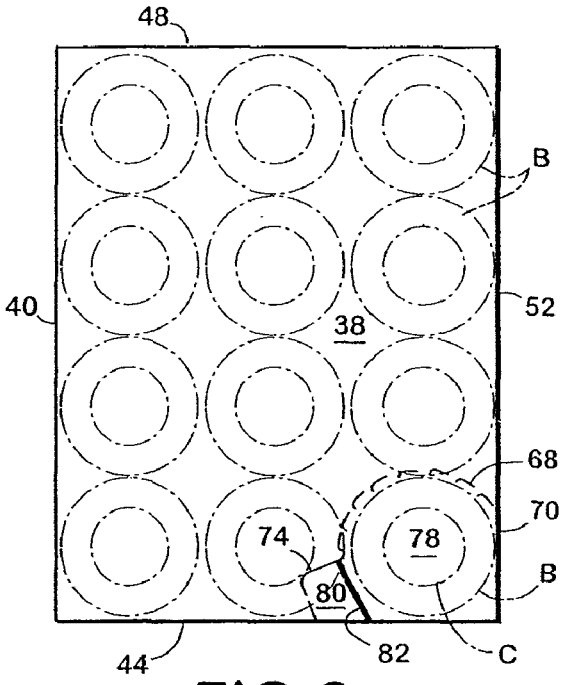
FIG. 2 is a side view of the carton loaded with bottles with a dispenser opening being located adjacent to the end of the carton on which the carton is placed on a surface.

This carton is loaded with bottles having smaller necks than bottom portions as illustrated by FIG. 2 which shows the bottle B with bottle cap C being adjacent to the top panel 38 where the dispensing flap 78 is located.

Figure 3:
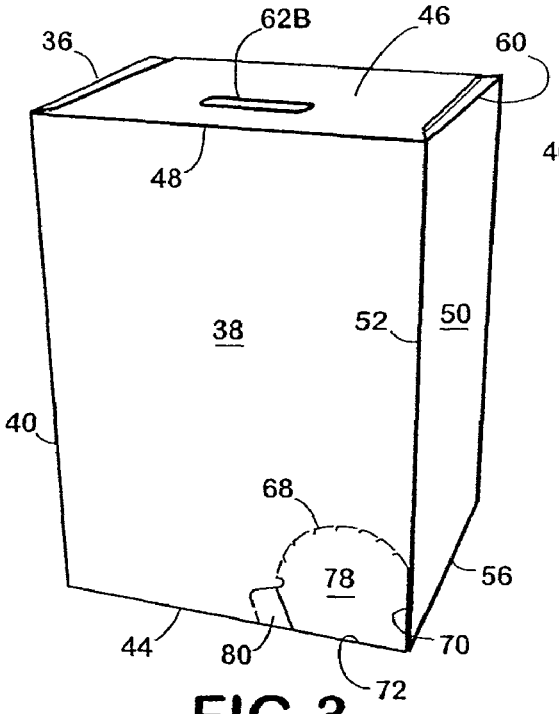
FIG. 3 is a perspective side view of the carton showing the dispenser flap intact.
Figure 4:
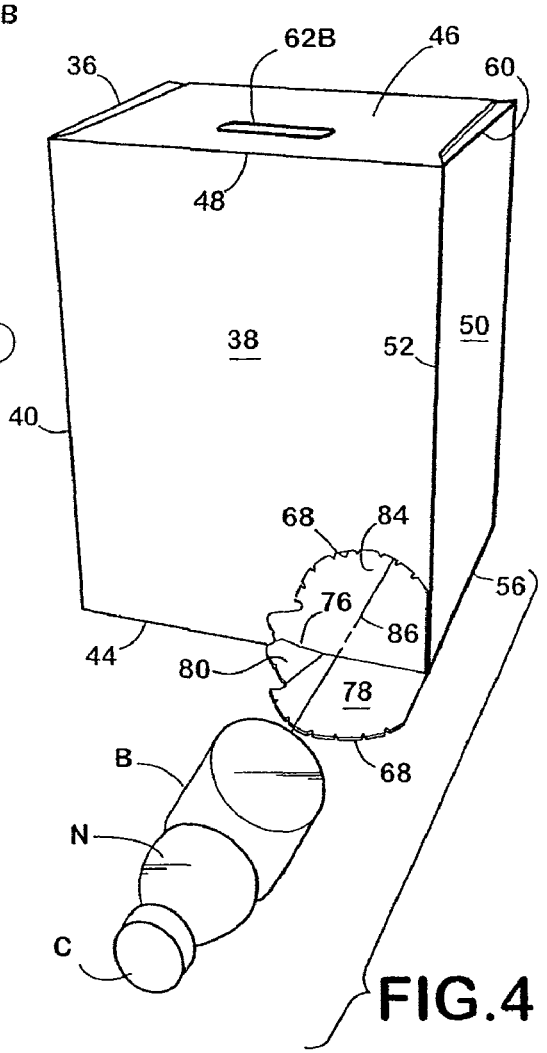
FIG. 4 is perspective side view of the carton with a bottle (B) having being removed from the dispenser. The longitudinal axis of the bottle (B) extends through the dispenser opening.

Bottles automatically roll into position for being dispensed by placing the carton on the end adjacent to the dispenser 78 as illustrated in FIG. 3. The dispenser flap 78 can be opened or removed while the carton is resting on the bottom panel 14 or when it has been placed on the end adjacent to the dispenser flap 78 as shown in FIG. 3. The dispenser flap 78 is removed by pushing pull tab 80 in and pulling out the pull tab 80. The dispensing flap 78 can be easily detached from the top panel 38 because of the loosely connected slits 74 and 76. Because of the leverage obtained in pulling the pull tab 80, the resistant tear lines 68, 70, and 72 holding the dispenser flap 78 in place can be overcome resulting in the removal of the dispenser flap 78.

A bottle B can then be removed through the resulting dispenser opening 84 by grasping the bottle B by its cap C and neck N and pulling it along its longitudinal axis 86 until it is removed from the carton. Another bottle will then drop into place for removal through the dispenser opening 84. It will be observed that the bottles B are placed in the carton with their longitudinal axes normal to top panel 38 and bottom panel 14 with the cap C of the bottle B being adjacent to the top panel 38.

It will be noticed that the dispenser flap 78 and dispenser opening 84 are basically circular but are truncated where resistant tear line 68 reaches fold line 52, with resistant tear line 70 extending to the intersection with resistant tear line 72 formed along fold line 44. Resistant tear line 68 preferable is interrupted by fold line 82 connecting dispenser 78 with pull tab 80 which facilitates the pull tab exerting the leverage on the dispenser flap 78 for ease of removal.

The tear line 70 can be made resistant or left as a fold line to permit the dispensing flap 78 to be reclosed after a bottle is removed. Alternatively, the portion of tear line 70 and tear line 72 can be left resistant to tearing so the dispensing flap 78 can be reclosed or both of these portions left as fold lines only.

A coupon or printed message can be attached or printed on the dispensing flap 78 as a point of purchase message.

It should be realized that the dispenser can be located in any corner of the top panel 38 and dispensers could be located in more than one location in the top panel. However it is preferred that there only be one dispenser in order to preserve the integrity of the carton.

It should be realized as discussed supra that the dispensing flap 78 can be left partially attached to the carton which may be advantageous when moving a carton from place to place as the flap can be closed to secure the carton. This carton is especially useful for carrying 16 or 20 ounce bottles in a 3×4 configuration. However, other sizes and configuration of bottles may be used.

While the invention has been disclosed in its preferred forms, it will be apparent to those skilled in the art that many modifications, additions, and deletions can be made therein without departing from the spirit and scope of the invention and its equivalents as set forth in the following claims.

Unique Features Of The Dispenser Of This Invention

One of the unique features of the dispenser of this invention is that it provides easy access for the removal of bottles with caps and necks of a smaller diameter than the body through a single dispenser opening. Two dispensers on the same longitudinal axis are not needed for this carton, as only a single dispenser is needed. The dispenser flap of this invention is resistant to accidental tearing by the weight of the adjacent container by the provision of resistant tear lines connecting the dispenser flap to the top of the carton. A pull tab has been provided that is loosely connected to the top panel of the carton so that it can be easily partially detached and provide the necessary leverage to remove the dispenser flap. The connection of the dispenser flap can be constructed so the flap can be completely removed or left partially attached for reclosing.

Because the dispenser of this invention is located in the top panel, the dispenser flap can be easily removed for dispensing bottles, but yet carried in its upright position by the handles without danger of the bottles falling out of the carton. Because the dispensing flap can be designed for easy removal from the carton, a coupon can be easily attached to the dispensing flap or a message printed on the dispensing flap for the convenience of the consumer.

Therefore, having thus described the invention, at least the following is claimed:

1. A method of removing containers from a carton, the method comprising:

obtaining a carton, the carton comprising:

a bottom panel;

a top panel including a corner;

a first side panel foldably connected to the top panel;

a second side panel foldably connected to the top panel at a first fold line including an end section;

a first plurality of end flaps at a first end of the carton, the first plurality of end flaps including a first top end flap foldably connected to the top panel at a second fold line, the second fold line including an end section, the end section of the first fold line and the end section of the second fold line intersecting with one another at the corner of the top panel;

a second plurality of end flaps at a second end of the carton; and at least one tear line defining a dispenser flap at least in the top panel, a section of the at least one tear line being coextensive with a section of one of the first and second fold lines, and the dispenser flap being adjacent to the first top end flap and the second side panel, wherein the carton encloses a plurality of containers, each container of the plurality of containers having substantially the same size and shape and having a top end, a longitudinal axis, and a bottom end;

forming a dispenser opening in at least the top panel of the carton, comprising tearing the dispenser flap at least partially along the at least one tear line, comprising tearing the section of the at least one tear line that is coextensive with the section of one of the first and second fold lines, wherein after the forming of the dispenser opening, the dispenser flap remains pivotably attached by an end section, which is selected from the group consisting of the end section of the first fold line and the end section of the second fold line, to a remainder of the carton, and the remainder of the carton contains the containers; and removing containers from the remainder of the carton through the dispenser opening.

2. The method of claim 1, wherein the longitudinal axes of the containers are generally perpendicular to planes of the top and bottom panels.

3. The method of claim 2, wherein the plurality of containers comprises at least twelve containers.

4. The method of claim 2, wherein the at least one tear line intersects the second fold line.

5. The method of claim 2, further comprising grasping the dispenser flap at a pull tab before tearing the dispenser flap along the at least one tear line.

6. The method of claim 5, wherein the plurality of containers comprises at least twelve containers.

7. The method of claim 6, wherein the at least one tear line intersects the second fold line.

8. The method of claim 1, wherein the dispenser flap is generally circular.

9. The method of claim 7, wherein the bottom ends are cylindrical.

10. The method of claim 1, wherein the dispenser flap includes the corner of the top panel.

11. The method of claim 1, wherein the section of the at least one tear line is coextensive with an end section that is:

selected from the group consisting of the end section of the first fold line and the end section of the second fold line, and different from the end section to which the dispenser flap remains pivotably attached after the forming of the dispenser opening.

12. The method of claim 1, wherein:

the section of the at least one tear line is coextensive with the end section of the first fold line, and the dispenser flap remains pivotably attached to the end section of the second fold line after the forming of the dispenser opening.

13. A method of removing containers from a carton, the method comprising:

obtaining a carton, the carton comprising:

a bottom panel;

a top panel including a corner;

a first side panel foldably connected to the top panel;

a second side panel foldably connected to the top panel at a first fold line including an end section;

a first plurality of end flaps foldably connected at a first end of the carton, the first plurality of end flaps including a first top end flap foldably connected to the top panel at a second fold line, the second fold line including an end section, the end section of the first fold line and the end section of the second fold line intersecting with one another at the corner of the top panel; and at least one tear line defining a dispenser flap at least in the top panel, a section of the at least one tear line being coextensive with a section of one of the first and second fold lines, and the dispenser flap being adjacent to the first top end flap and the second side panel, wherein the carton encloses at least twelve containers, each container of the twelve containers having a top end, a longitudinal axis, and a bottom end;

grasping the dispenser flap at a pull tab;

forming a dispenser opening in at least the top panel of the carton, comprising tearing the dispenser flap at least partially along the at least one tear line, comprising tearing the section of the at least one tear line that is coextensive with the section of one of the first and second fold lines, wherein after the forming of the dispenser opening, the dispenser flap remains pivotably attached by an end section, which is selected from the group consisting of the end section of the first fold line and the end section of the second fold line, to a remainder of the carton, and the remainder of the carton contains the containers; and removing containers from the remainder of the carton through the dispenser opening.

14. The method of claim 13, wherein the longitudinal axes of the containers are generally perpendicular to planes of the top and bottom panels.

15. The method of claim 14, wherein the bottom ends are cylindrical.

16. The method of claim 13, wherein the section of the at least one tear line is coextensive with an end section that is:

selected from the group consisting of the end section of the first fold line and the end section of the second fold line, and different from the end section to which the dispenser flap remains pivotably attached after the forming of the dispenser opening.

17. The method of claim 13, wherein:

the section of the at least one tear line is coextensive with the end section of the first fold line, and the dispenser flap remains pivotably attached to the end section of the second fold line after the forming of the dispenser opening.

18. A method of removing containers from a carton enclosing at least twelve containers, the method comprising:

obtaining a carton, the carton comprising:

a bottom panel;

a top panel including a corner;

a first side panel foldably connected to the top panel;

a second side panel foldably connected to the top panel at a first fold line including an end section;

a first plurality of end flaps at a first end of the carton, the first plurality of end flaps including a first top end flap foldably connected to the top panel at a second fold line, the second fold line including an end section, the end section of the first fold line and the end section of the second fold line intersecting with one another at the corner of the top panel; and at least one tear line defining a dispenser flap at least in the top panel, a first section of the at least one tear line being coextensive with a first end section selected from the group consisting of the end section of the first fold line and the end section of the second fold line, the dispenser flap including the corner of the top panel, the dispenser flap being adjacent to the first top end flap and the second side panel, and the at least one tear line including a second section having a first end adjacent to the first fold line, and a second end adjacent to the second fold line, wherein the carton encloses a plurality of containers, each container of the plurality of containers having substantially the same size and shape and having a top end, a longitudinal axis, and a bottom end;

grasping the dispenser flap at a pull tab;

forming a dispenser opening in at least the top panel of the carton, comprising tearing the dispenser flap at the at least one tear line, comprising tearing the first section of the at least one tear line that is coextensive with the first end section selected from the group consisting of the end section of the first fold line and the end section of the second fold line, wherein after the forming of the dispenser opening, the dispenser flap remains pivotably attached by a second end section to a remainder of the carton, the second end section is different from the first end section, the second end section is selected from the group consisting of the end section of the first fold line and the end section of the second fold line, and the remainder of the carton contains the containers; and removing containers from the remainder of the carton through the dispenser opening.

19. The method of claim 18, wherein the longitudinal axes of the containers are generally perpendicular to planes of the top and bottom panels.

20. The method of claim 19, wherein the bottom ends are cylindrical.

21. A method of removing containers from a carton, the method comprising:

obtaining a carton, the carton comprising:

at least four panels, including a first panel and a second panel foldably connected to one another by a fold line;

a plurality of end flaps at an end of the carton, the end flaps being separated from the four panels along a transverse line, the transverse line being perpendicular to the fold line; the plurality of end flaps including a first end flap; and a dispenser flap at least in the first panel, the dispenser flap being defined at its perimeter in the first panel at least partially by a tear line, and a section of the tear line being coextensive with a section of one of the fold line and the transverse line, wherein the carton encloses a plurality of containers, each container of the plurality of containers having substantially the same size and shape and having a top end, a longitudinal axis, and a bottom end;

forming a dispenser opening in the carton, comprising tearing the dispenser flap at least partially along the tear line, comprising tearing along the section of the tear line that is coextensive with the section of one of the fold line and the transverse line, wherein after the forming of the dispenser opening, the dispenser flap remains pivotably attached to a remainder of the carton along either the fold line or the transverse line, and wherein the remainder of the carton contains the containers; and removing containers from the remainder of the carton through the dispenser opening.

* * * * *